US005642911A

United States Patent [19]

Gatch

[11] Patent Number: 5,642,911

[45] Date of Patent: Jul. 1, 1997

[54] LITTER RETRIEVING TOOL

[76] Inventor: Donald F. Gatch, P.O. Box 402, Hardeeville, S.C. 29927

[21] Appl. No.: 543,292

[22] Filed: Oct. 16, 1995

[51] Int. Cl.[6] ..... A01D 9/06

[52] U.S. Cl. ..... 294/61; 294/50

[58] Field of Search ..... 294/19.1, 50, 50.5–50.7, 294/55.5, 61; 43/6; 172/21, 22, 25, 378

[56] References Cited

U.S. PATENT DOCUMENTS

| | | | |
|---|---|---|---|
| 1,246,487 | 11/1917 | Summers et al. | 294/61 |
| 1,970,093 | 8/1934 | Homan | 294/61 |
| 1,993,314 | 3/1935 | Belford | 294/61 |
| 2,500,647 | 3/1950 | Schulthess | 294/61 |
| 2,552,467 | 5/1951 | Thomas | 294/61 |
| 2,695,188 | 11/1954 | Klausman et al. | 294/61 |
| 2,738,215 | 3/1956 | Thompson | 294/61 |
| 2,804,336 | 8/1957 | Thompson | 294/50 X |
| 3,183,031 | 5/1965 | Haberstick | 294/61 X |
| 3,633,958 | 1/1972 | Mesrobian | 294/61 |
| 3,712,660 | 1/1973 | Moore | 294/61 |
| 3,873,143 | 3/1975 | Foust | 294/61 |
| 4,856,835 | 8/1989 | Pacione | 294/61 |

*Primary Examiner*—Johnny D. Cherry

[57] ABSTRACT

A litter gathering device consisting of an improved mechanism for retrieval and discharge of litter which uses a plurality of spikes mounted on a rubber plate allowing them to flex. The litter gathering device has a handle attached on top of an elongated hollow tubular member with a flange attached at the bottom. The flange has a threaded shaft where attached is a hard rubber plate containing a plurality of spikes. The invention has a discharge mechanism which involves a slidable shaft inside the elongated hollow tubular member. Attached at the lower end is a discharge plate containing a plurality of holes matching the plurality of spikes. Attached transversely through the slidable shaft is a smaller shaft with ends allowed to protrude through slots in the elongated hollow tubular member. Flanges are attached on both ends of the smaller shaft which are latchable into a wire handle of bucket. The discharge mechanism is held in a retractable position against the rubber plate by a coiled spring attached to the top of the slidable shaft. The coiled spring is attached to the top of the elongated hollow tubular member by a wire. Another larger diameter tubular member is slidable over the hollow elongated hollow tube between the handle and the protruding flanges of the discharge mechanism. This larger diameter tubular member is used to discharge litter from the plurality of spikes and as a guide for the plurality of spikes towards targeted litter.

2 Claims, 1 Drawing Sheet

LITTER RETRIEVING TOOL

BACKGROUND OF THE INVENTION

1. Field of the Invention

This invention relates to litter retrieval tools and, in particular, is a tool with a plurality of spikes for piercing and retrieving litter and a discharging mechanism for discharging litter from the plurality of spikes. The invention is designed to work in coordination with a bucket having a wire handle.

2. Prior Art

Retrieving of litter has long been a nuisance. It has been a back-breaking job to pick litter up by hand. This invention will virtually eliminate the need to bend over and retrieve litter by hand.

Other inventions have tried to solved this problem in various ways. U.S. Pat. Nos. 1970093 and 3183031 are a couple of inventions which use a single spike mounted at the end of a tubular member. There are a couple of problems with this single spike tool for retrieving litter. First, it is sometimes hard to pierce hit a small piece of litter, such as a cigarette butt, with a single spike. Second, the trash or litter may easily fall off a single spike. However, my invention has a plurality of spikes at the end of the tubular member. With a plurality of spikes there is a better chance that one of the spikes will pierce the litter. Usually several of the spikes pierce the litter, retaining the litter more securely until ready for discharge.

There have been other inventions which have tried to solve the problem by using a plurality of spikes. These inventions used a plate with a plurality of holes matching the plurality of spikes allowing the plurality of spikes to protrude through. The plate is used for the purpose of discharging of litter from the plurality of spikes.

On Mar. 5, 1935 R. Belford, U.S. Pat. No. 1,993,314, invented a litter retrieving tool containing a plurality of spikes. There is a handle attached to the top end of a elongated hollow tubular member and at the bottom end of the elongated hollow tubular member is a plate containing the plurality of spikes. Inside the elongated hollow tubular member is a slidable shaft and attached to the slidable shaft is a plate containing a plurality of matching holes for the plurality of spikes. The plate is slidable over the plurality of spikes and the purpose of the plate is discharging litter. Mounted transversely at the other end of the slidable shaft is a smaller shaft. The smaller shaft protrudes through slits found in the elongated hollow tubular member. A handle, which is slidable over the elongated hollow tubular member, is fixed to the slidable shaft by the smaller shaft. The slidablity of the handle is controlled by the length of the slit in the elongated tubular member. Discharging of litter is accomplished by grasping the top handle with one hand and grasping the slidable handle with the other hand, whereby pushing downward on the slidable handle which is fixed to slidable shaft, will force the discharge plate downward to discharge the litter from the plurality spikes. This type of handle only allows discharging of litter.

But I, Donald F. Gatch, have added another dimension to the slidable handle. The handle I have designed is not fixed to the slidable shaft in the elongated hollow tubular member as inside U.S. Pat. No. 1,993,314. The handle a is short tubular member, with a larger inner diameter, which is slidable between the handle attached on top of the elongated tubular member and a flanged shaft protruding through slits found in the elongated hollow tubular member allowing movement independently of the discharge mechanism. Because the non-fixed slidable handle can work independently of the discharge mechanism, it can serve two functions. First, the handle can be used to discharge litter by grasping the top handle in one hand and grasping and pushing push downward on the non-fixed slidable handle with the other hand. This causes the bottom of the non-fixed slidable handle to butt against the flanged shaft, forcing the flanged shaft downward, which forces the discharge plate downward as well. This flanged shaft is only one part of several parts which make up the discharge mechanism, which discharges litter from the plurality of spikes. The flanged shaft of the discharge mechanism is mounted transversely through a larger slidable shaft inside the elongated hollow tubular member. Attached to the other end of the larger slidable shaft is a discharge plate. The discharge plate contains a plurality of holes matching the plurality of spikes, making the discharge plate slidable over the plurality of spikes. The second function of the non-fixed slidable handle is as a guide for the plurality of spikes. This is accomplished by grasping the non-fixed slidable handle with one hand and grasping the handle attached on top of the elongated hollow tubular member with the other and guiding the plurality spikes toward targeted litter. This can be very handy when litter lies in out of reach places, such as under low lying tree branches.

There were other patents with a plurality of spikes for retrieving litter. The following U.S. Pat. No. are representative: 1,246,487, 2,500,647, 2,738,215, 3,633,958 and 4,856,835. U.S. Pat. No. 2,500,647, inventor Ernest Shuithers; and U.S. Pat. No. 2,738,215, inventor B. Thompson are similar to my invention. These inventions use a discharging mechanism which is designed to be pushed down with a foot, forcing the discharge plate downward, discharging litter from the plurality of spikes. There are several problems with using your foot to operate the discharge mechanism,it is awkward to balance yourself on one foot while using the other foot to push the mechanism down while grasping the handle with your hands. You will need to be very coordinated to accomplish this motion without losing your balance. There is an even greater problem with this foot discharge mechanism. A foot can only be lifted a short distance from the ground. Therefore, whatever the litter is to be discharged into will have to be low to the ground. Inventor Bryan Thompson, in U.S. Pat. No. 2,738,215 says "The lever is operated by user's foot, so that the refuse can be discharged into a truck bed if desired." The only way this could be accomplished is by climbing in and out of the truck bed with the tool every time which is very inefficient.

But I, Donald F. Gatch, have designed a similar discharging mechanism which works with the wire handle of a bucket and can be used while carrying the bucket. These types of buckets are very common and come in various sizes, shapes and materials, such as metal or plastic. My discharge mechanism works like this: while carrying a bucket in one hand, and my invention in the opposite hand, the flanged shaft of the discharge mechanism can be latched into the wire handle of the bucket where the invention can then be drawn upward forcing the discharge plate downward discharging the litter from the plurality of spikes, whereby litter will fall into the bucket. This design of the discharging mechanism has a couple of advantages over a foot operated discharge mechanism. First, you do not need to be as coordinated to use this invention as with a foot operated discharge mechanism. Second, this invention is more efficient. When litter is retrieved, it can be discharged immediately or whenever desired into a bucket for temporary storage. The bucket can be emptied whenever desired, into a truck bed or larger trash container. If the truck bed happens to be near or convenient for receiving litter into, my invention has the capability of discharging the litter directly into back of the truck bed without having to climb in the back of the truck at all. This is accomplished by using the slidable handle, previously described, to discharge the litter from the plurality of spikes into the truck bed.

SUMMARY OF THE INVENTION

The principal object of the present invention is to provide a versatile litter retrieving tool with an improved method of retrieving and discharging litter.

It is also the object of the present invention to provide a light weight, sturdy, simply operated tool, of inexpensive construction.

Another object of the present invention is to provide a tool for easy, efficient retrieval of litter which does not require bending at the back. This makes the device not only convenient and less tiring for able-bodied persons, but also allows its use by individuals with various disabilities who may have difficulty bending over or coordinating the use of several limbs.

The foregoing objects can be accomplished by providing a litter retrieving tool having a handle attached to an upper light weight elongated hollow tubular member. At the other lower end of the elongated hollow tubular member is attached a head comprised of a flange having a short threaded shaft on the underneath side attached to short threaded shaft is a plate containing a plurality of spikes projecting from the plate. Inside the elongated hollow tubular member is a slidable shaft which has a discharge plate attached to the lower end. The discharge plate has a plurality of holes matching the plurality of spikes making the discharge plate slidable up and down the plurality of spikes. The discharge plate strips litter from the plurality of spikes. At the top of the slidable shaft is an attached coiled spring. The top end of the coiled spring is attached at the bottom end of a wire having a loop tied in the end. The wire is pulled tightly and then the long end of the wire is attached to the top of the elongated hollow tubular member. This keeps the discharge plate in a retractable position. Another smaller shaft is mounted transversely through the slidable shaft and protrudes through slits in the elongated hollow tubular member. Attached to the two ends of the smaller shaft are caps cresting flanges. These flanges are used to catch in the wire handle of a bucket so that drawing the tool upward will force the discharge plate downward discharging litter from the plurality of spikes into the bucket for temporary storage.

In addition, there is a shorter tubular member, with a larger inner diameter, which is slidable over the elongated hollow tubular member and is slidable between the handle attached on top of the elongated hollow tubular member and the flanged shaft protruding through slits in the elongated hollow tubular member. The shorter slidable tubular member has two functions. One function of the shorter slidable tubular member is discharging litter. By pushing the shorter slidable tubular member downward the bottom end of the shorter slidable tubular member butts against the flanged shaft. This flanged shaft is mounted transversely through a larger slidable shaft inside the elongated hollow tubular member. The discharge plate attached to the other end of the larger slidable shaft is forced downward stripping litter from the plurality of spikes. Another purpose of the outer tubular member is to function as a guide. By grasping the handle attached on top of the elongated hollow tubular member in one hand and grasping the shorter slidable tubular member in the other hand, the plurality of spikes can be guided toward targeted litter. Exactly how the invention is put together and how it work will become more clear in the detailed description section.

DETAILED DESCRIPTION OF THE INVENTION

Figure 1:
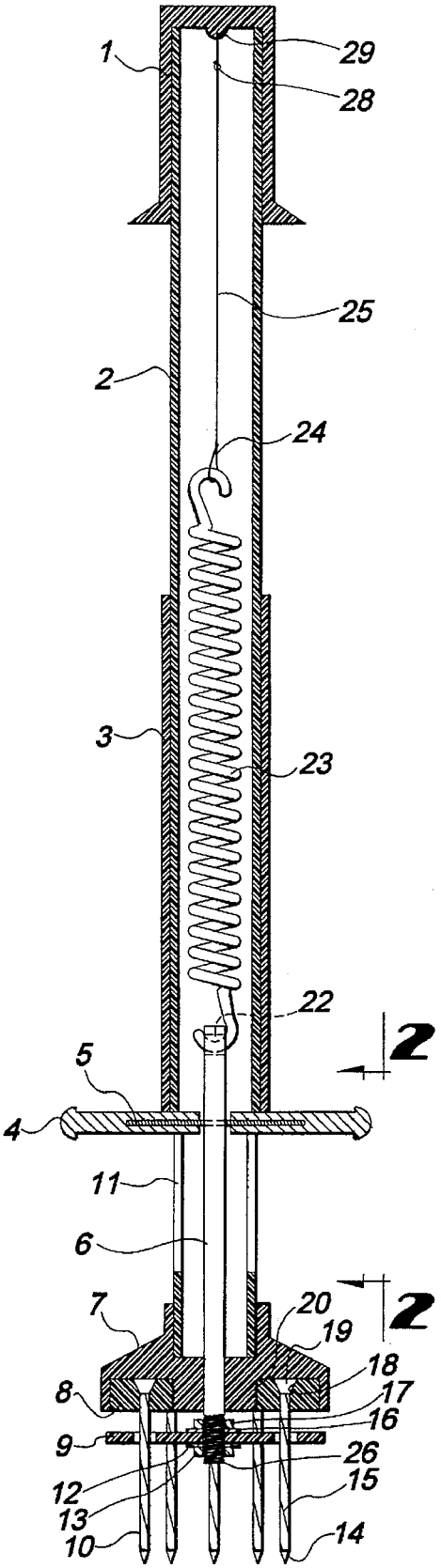
FIG. 1 is a longitudinal cross-sectional view of the present invention along the line 1—1.
Figure 3:
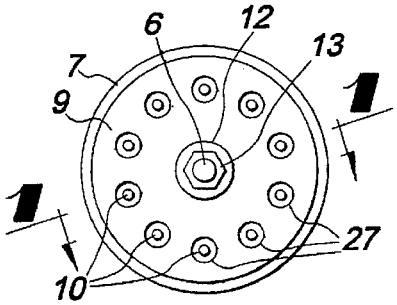
FIG. 3 is a bottom end view of FIG. 1 of the present invention.

Refer now to FIG. 1, which is an overall drawing of a preferred embodiment of the invention, which may be made of any suitable materials (i.e., metal, aluminum, plastic, etc.). Now referring back to FIG. 1 in detail, numeral 2 designates an elongated hollow tubular member approximately thirty-seven inches long, with an outer-diameter of approximately three quarters of an inch. Attached to the bottom end of the elongated hollow tubular member 2 is a flange 7. On the underneath side of flange 7 is a short threaded shaft 20. Attached to the short threaded shaft 20 in a threaded relation is hard rubber annular disc 8. The hard rubber annular disc 8 contains a plurality of spikes 10 which are used to pierce litter. The preferred arrangement of plurality of spikes 10 are arranged in a circular fashion on the hard rubber annular disc 8 as shown in FIG. 3. Each of the spikes includes a head 19 which is snugly seated in a countersunk recess 18 on the top side of the hard rubber annular disc 8. The body of the plurality of spikes 10 is a spiral grooved body 15, which finishes out to a smooth point 14. The smooth point 14 serves to pierce the litter readily and the spiral grooved body 15 serves to secure the litter until ready for discharge.

Reciprocally and slidably arranged inside the elongated hollow tubular member 2 is a shaft 6 which is threaded at the lower end 26. Attached to the lower threaded end 26 of the shaft 6 is a discharge plate 9. The discharge plate 9 is attached to shaft 6 by having in a threaded relation a nut 17 of approximately one-half inch followed by a washer 16 of approximately seven-sixteenth inch on the top side of the discharge plate 9. On the face side of the discharge plate 9 is another washer 12 of approximately seven-sixteenth inch and in a threaded relation is a another nut 13 of approximately one-half inch, tightened against washer 12 locking the discharge plate 9 in place on the shaft 6. The discharge plate has a plurality of holes 27, matching the plurality of spikes 10 as shown in Fib 3. The plurality of holes 27 are slightly larger than the bodies of the plurality of spikes 10, allowing the discharge plate to be slidable over the plurality of spikes 10.

Figure 2:
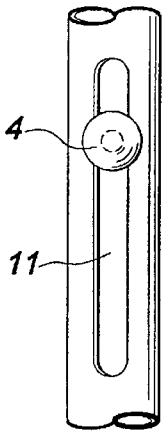
FIG. 2 is a close up sectional view of the discharge mechanism of the invention along the lines 2—2 in FIG. 1.

About two inches from the top of shaft 6 is mounted transversely a smaller shaft 5. The ends of the smaller shaft 5 are allowed to protrude through the slots 11 in the elongated hollow tubular member 2 as show in FIG. 2. Attached onto protuding ends of transversely mounted shaft 5 are flanges 4, which are designed to latch in the wire handle of a bucket whereby drawing the invention upward will force the shaft 6 downward, forcing the discharge plate 9 downward to discharge the litter from the plurality of spikes 10. About one-quarter inch from the top of shaft 6 is a hole 22 about one-eighth inch in diameter where a coiled spring 23 is hooked into shaft 6. The top of the coiled spring 23 is hooked into a loop 24 which is made by twisting the end of the wire 25 around the main body of the wire 25. The long end of the wire 25 is pulled tightly over the slot 29 and back down the outside of elongated hollow tubular member 2 and back through the hole 28. The wire 25 is then pulled up through the elongated hollow tubular member 2 and over the slot 29 and back down the outside of elongated hollow tubular member 2 and through hole 28 again attaching the wire 25 to the top of elongated hollow tubular member 2. This tying procedure just described may be performed as many times as needed to attach the wire 25 to the top of elongated hollow tubular member 2. The wire 25 now has the coiled spring 23 in a stretched position; thus, the coiled spring 23 normally urges the discharge plate 9 in a position contiguous to the hard rubber annular disc 8.

Over the outside of elongated hollow tubular member 2 is another hollow, slidable, larger diameter tubular member 3 with an inner diameter of approximately seven-eighths of an inch. Attached on top of tubular member 2 is a handle 1 which provides a point of grasping the invention. The previous description lays out the preferred configuration of the invention.

The usefulness of this invention and its advantages over previous inventions will become apparent with the basic teaching of the methods of operation. With this invention having its parts as shown in FIG. 1, there are several different methods of operation which can be performed by an operator. The first method of operation is the retrieval of litter performed by grasping the handle 1 and by using substantial press, to pierce the litter with the plurality of spikes 10, whereby the litter will be held by the plurality of spikes 10 for disposal. Another method of operation is retrieval of litter by the use of handle 1 and hollow, slidable, larger, diameter tubular member 3. By grasping handle 1 with one hand and with the other hand grasping the hollow, slidable, larger, diameter tubular member 3, the hollow, slidable, larger diameter tubular member 3 is held in a fixed position and used as a guide. Handle 1 is used to slide hollow, elongated, tubular member 2 up and down inside the fixed, hollow, slidable, larger diameter tubular member 3, which is used to guide the plurality of spikes 10 toward the targeted litter. This is a very useful method of operation when litter lies in out of reach places such as under low lying tree branches.

As there were two methods of retrieval, there are also two methods of discharge of litter from the plurality of spikes. The first method of discharging litter involves the use of handle 1 and hollow, slidable, larger diameter tubular member 3. One hand is used to grasp handle 1, while the other hand grasps hollow, slidable, larger, diameter tubular member 3, where by pushing downward on the bottom end of hollow, slidable, larger diameter tubular member 3 causes the hollow slidable larger diameter tubular member 3 to butt against caps 4 forcing shaft 6 downward and in conjunction forcing the discharge plate 9 downward, whereby discharging litter from the plurality of spikes 10. The second method of discharging litter from the plurality of spikes is by grasping handle 1 with one hand while carrying the bucket by its wire handle in the other hand, and latching one of the flanges 4 in the wire handle of the bucket and, by drawing handle 1 in an upward motion, forcing shaft 6 downward, and in conjunction forcing the discharge plate 9 downward discharging litter from the plurality of spikes 10, whereby the litter will fall into the bucket which can serve as permanent storage or temporary storage of litter. The foregone description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

I claim:

1. A litter gathering device comprising of a vertically attached handle on top of an elongated hollow tubular member, and attached on the lower end of the elongated hollow tubular member is a flange having a short threaded shaft on the underneath side where a rubber plate is attached in a thread relation having a plurality of spikes projecting from said rubber plate and reciprocally and slidably arranged in said elongated hollow tubular member is a slidable shaft, and attached to the lower end of said slidable shaft is a discharge plate having a plurality of holes matching the plurality of spikes making the discharge plate slidable over the plurality of spikes, and on said slidable shaft is a smaller shaft which is mounted transversely and the ends protrude through slots in said elongated hollow tubular member and on each end of the said smaller transversely mount shaft are attached flanges, and at the upper end of said slidable shaft is a hole where a coiled spring is attached, and attached at the top of said coiled spring is a wire containing a twisted loop in the end, and said wire is pulled tight, normally urging said discharge plate against said rubber plate containing plurality of spikes and the other end of said wire is bent over a groove at the top of said elongated hollow tubular member, said wire is then pulled along the outside of said elongated hollow tubular member and pushed back through a hole found near the top of said elongated hollow tubular member and on the same side as said groove, attaching said wire to the top of said elongated hollow tubular member, and mounting over the tied wire at the top of said elongated hollow tubular member is said handle, and mounting slidable over said elongated hollow tubular member, and between said handle and said flanges is a larger diameter tubular member.

2. In the litter gathering device of claim 1 where said plate containing a plurality of spikes is made of hard rubber, allowing the plurality of spikes to flex.

* * * * *